US008997274B2

(12) United States Patent
Phillips

(10) Patent No.: US 8,997,274 B2
(45) Date of Patent: Apr. 7, 2015

(54) ADJUSTABLE FURNITURE APPARATUS

(71) Applicant: Edward Phillips, Deltona, FL (US)

(72) Inventor: Edward Phillips, Deltona, FL (US)

( * ) Notice: Subject to any disclaimer, the term of this patent is extended or adjusted under 35 U.S.C. 154(b) by 184 days.

(21) Appl. No.: 13/748,095

(22) Filed: Jan. 23, 2013

(65) Prior Publication Data

US 2014/0203608 A1 Jul. 24, 2014

(51) Int. Cl.

| | |
|---|---|
| ***A47C 20/04*** | (2006.01) |
| ***A47C 20/08*** | (2006.01) |
| ***A61G 7/015*** | (2006.01) |
| ***A47C 1/024*** | (2006.01) |
| ***A47C 1/026*** | (2006.01) |
| ***A47C 1/034*** | (2006.01) |
| ***A47C 15/00*** | (2006.01) |

(52) U.S. Cl.

CPC ..... *A47C 20/041* (2013.01); *A61G 7/015* (2013.01); *A47C 20/08* (2013.01); *A47C 1/0242* (2013.01); *A47C 1/0244* (2013.01); *A47C 1/026* (2013.01); *A47C 1/0342* (2013.01); *A47C 15/008* (2013.01)

(58) Field of Classification Search

CPC ..... A61G 7/015; A61G 13/08; A47C 20/041; A47C 20/04; A47C 20/08

USPC ..... 5/37.1, 2.1, 57.1, 59.1, 634, 613, 614, 5/616, 618; 297/118

See application file for complete search history.

(56) References Cited

U.S. PATENT DOCUMENTS

| | | | | | |
|---|---|---|---|---|---|
| 6,594 | A | * | 7/1849 | Linikin | 297/108 |
| 142,249 | A | * | 8/1873 | Lovell | 5/30 |
| 154,060 | A | * | 8/1874 | Mahler | 5/610 |
| 255,809 | A | * | 4/1882 | Franck et al. | 16/366 |
| 304,282 | A | * | 8/1884 | Skau | 5/618 |
| 661,232 | A | * | 11/1900 | Shipley | 5/613 |
| 681,186 | A | * | 8/1901 | Bowie | 5/618 |
| 847,758 | A | * | 3/1907 | Frye | 5/604 |
| 861,868 | A | * | 7/1907 | Lewis | 5/613 |
| 874,555 | A | * | 12/1907 | Woollen | 5/607 |
| 892,405 | A | * | 7/1908 | Condon | 5/613 |
| 987,423 | A | * | 3/1911 | Barnett | 5/618 |
| 2,031,124 | A | * | 2/1936 | Perlesz et al. | 297/320 |
| 2,287,552 | A | * | 6/1942 | Dry | 5/604 |
| D154,031 | S | * | 6/1949 | Eisendrath | D6/361 |
| 2,675,285 | A | * | 4/1954 | Terry et al. | 5/618 |
| D193,322 | S | * | 7/1962 | Thomas | D24/215 |
| 3,124,388 | A | * | 3/1964 | Berlin | 297/320 |
| 3,143,803 | A | * | 8/1964 | Lunn | 433/33 |
| 3,211,495 | A | * | 10/1965 | Nielsen | 297/68 |
| D242,191 | S | * | 11/1976 | Halsted | D6/361 |
| 4,034,972 | A | * | 7/1977 | Peterson | 5/618 |
| 4,057,240 | A | * | 11/1977 | Damico et al. | 5/611 |
| D279,239 | S | * | 6/1985 | Meier | D6/361 |
| D299,190 | S | * | 1/1989 | Mulhauser | D6/367 |
| 4,893,365 | A | * | 1/1990 | Justice | 5/613 |
| 4,928,332 | A | * | 5/1990 | Ogden et al. | 5/614 |
| 4,970,737 | A | * | 11/1990 | Sagel | 5/620 |
| 5,040,253 | A | * | 8/1991 | Cheng | 5/616 |
| 5,083,625 | A | * | 1/1992 | Bleicher | 180/65.1 |

(Continued)

*Primary Examiner* — Nicholas Polito
*Assistant Examiner* — Eric Kurilla
(74) *Attorney, Agent, or Firm* — Jason T. Daniel, Esq.; Daniel Law Offices, P.A.

(57) ABSTRACT

An adjustable furniture apparatus is disclosed. The furniture apparatus includes a frame, an internal support structure, an incline assembly having a first and a second inclinable section, a plurality of lifting devices configured to selectively incline and support the first and second inclinable sections, and a cover disposed over portions of the incline assembly to form a comfortable seating intimate activity surface.

16 Claims, 9 Drawing Sheets

(56) References Cited

U.S. PATENT DOCUMENTS

| | | | | |
|---|---|---|---|---|
| 5,102,193 | A * | 4/1992 | Goss et al. | 297/362.13 |
| 5,170,522 | A * | 12/1992 | Walker | 5/615 |
| 5,224,228 | A * | 7/1993 | Larrimore | 5/613 |
| 5,231,741 | A * | 8/1993 | Maguire | 27/12 |
| 5,687,437 | A * | 11/1997 | Goldsmith | 5/611 |
| 5,787,528 | A * | 8/1998 | Antinori | 5/616 |
| 6,213,555 | B1 * | 4/2001 | Sulpizio et al. | 297/377 |
| 6,679,555 | B2 * | 1/2004 | Bangert | 297/316 |
| D509,670 | S * | 9/2005 | Carter | D6/361 |
| 7,207,622 | B2 * | 4/2007 | Cohan et al. | 297/31 |
| 7,669,254 | B2 * | 3/2010 | Mortimer-McKenzie | 5/4 |
| 8,500,202 | B2 * | 8/2013 | Nielsen et al. | 297/316 |
| 2007/0169266 | A1 * | 7/2007 | Kim | 5/607 |
| 2008/0016616 | A1 * | 1/2008 | Roleder et al. | 5/2.1 |
| 2011/0197361 | A1 * | 8/2011 | Hornbach et al. | 5/618 |
| 2011/0247138 | A1 * | 10/2011 | Clenet et al. | 5/613 |
| 2012/0217777 | A1 * | 8/2012 | Solheim | 297/232 |
| 2013/0247302 | A1 * | 9/2013 | Chacon et al. | 5/613 |

* cited by examiner

ADJUSTABLE FURNITURE APPARATUS

TECHNICAL FIELD

This disclosure relates to furniture, and more particularly to a seating system, such as a sofa, bench, love seat or chair having inclinable seat sections.

BACKGROUND

The statements in this section merely provide background information related to the present disclosure and may not constitute prior art.

Convertible seat bed units, couches, and reclinable chair of various constructions and useable both for seating and sleeping are well known in the art. Known configurations include adjustable reclining backrests and various control assemblies to self-adjust the backrest position. The seat may be slidably, horizontally adjust to accommodate movement of the backrest and movement of a footrest. The various reclining and adjusting assemblies are generally not adapted for durable use or extended user movement on top of the seats and couches. For example, many convertible seat bed units, couches, and reclining or adjustable chairs are configured for sitting or lying, and are not configured for more active use such as lovemaking at a selectable incline. To this end, these more conventional furniture units are not capable of supporting the full weight of one or more adults at locations other than the seat portion itself.

Further, known furniture configured to aid sexual intercourse can be difficult to possess, display or store discreetly without embarrassment. Therefore, it would be advantageous to configure a furniture apparatus for use as an aid for sexual intercourse that may be stored and displayed as a conventional furniture piece, concealing the internal incline assembly and incline functionality from external view.

Accordingly, a need remains for a discreet furniture apparatus that is configured to support active movement by users along all portions of the apparatus and configured to selectively incline at dual ends to improve user comfort when engaging in active use.

SUMMARY

An apparatus is disclosed for inclining seat sections of a furniture unit. The inclinable furniture apparatus includes a frame, an incline assembly having a first and a second inclinable section, a plurality of lifting devices configured to selectively incline and support the first and second inclinable sections, and a cover disposed over portions of the incline assembly to form a comfortable seating intimate activity surface.

Certain embodiments of the invention include a feature of discreet or hidden presentation of inclinable features of a furniture unit configured to aid lovemaking.

This summary is provided merely to introduce certain concepts and not to identify key or essential features of the claimed subject matter.

BRIEF DESCRIPTION OF THE DRAWINGS

One or more embodiments will now be described, by way of example, with reference to the accompanying drawings, in which.

DETAILED DESCRIPTION

Figure 1:
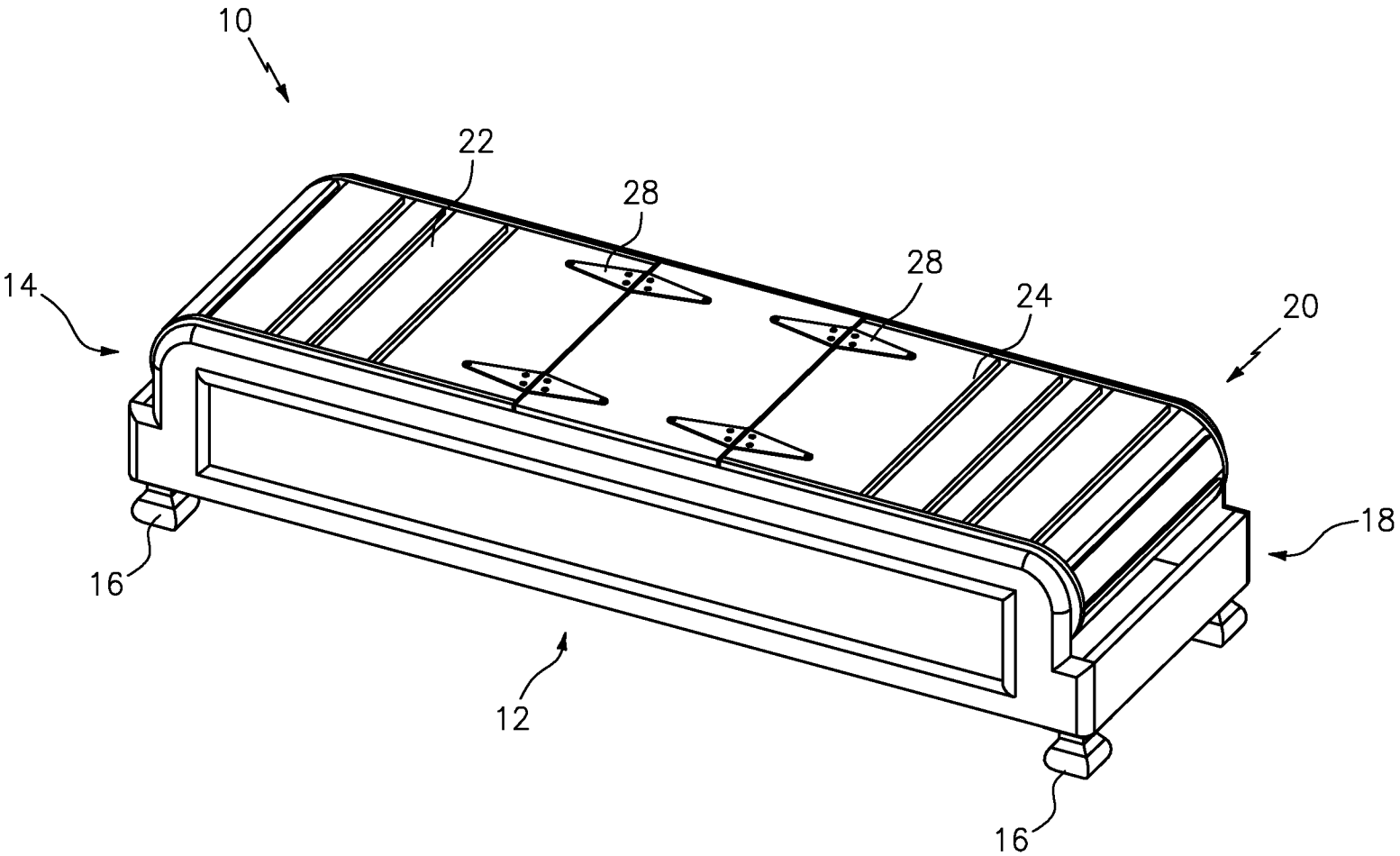
FIG. 1 shows the furniture apparatus in a non-inclined position, in accordance with the present disclosure.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" includes plural reference, and the meaning of "in" includes "in" and "on." The phrase "in one embodiment," as used herein does not necessarily refer to the same embodiment, although it may. Similarly, the phrase "in some embodiments," as used herein, when used multiple times, does not necessarily refer to the same embodiments, although it may. As used herein, the term "or" is an inclusive "or" operator, and is equivalent to the term "and/or," unless the context clearly dictates otherwise. The term "based, in part, on", "based, at least in part, on", or "based on" is not exclusive and allows for being based on additional factors not described, unless the context clearly dictates otherwise.

Referring now to the drawings, wherein the depictions are for the purpose of illustrating certain exemplary embodiments only and not for the purpose of limiting the same, FIG. 1 shows one embodiment of the furniture apparatus 10 in a non-inclined position. The furniture apparatus includes a frame 12 having a pair of opposed ends 14 and 18, respectively, and an incline assembly 20 situated within the frame 12 and attached as described herein below. The incline assembly 20 includes first and second incline sections 22 and 24, respectively. The inclinable sections 22 and 24 rotate about an axis defined by one or more hinges 28. The frame 12 is attached to a plurality of legs 16. The frame 12 is preferably constructed of wood, as shown, however other materials may also be utilized, such as metal, and their use will still be within the scope of the invention. The hinges 28 may be of any known type including a piano hinge; however, any leaf hinge would also function in a suitable manner. To operate the furniture apparatus 10 in changing its incline position, a user simply grasps the inclinable sections 22 and 24 and pulls upwardly which pivots the sections about the hinges 28.

Figure 2:
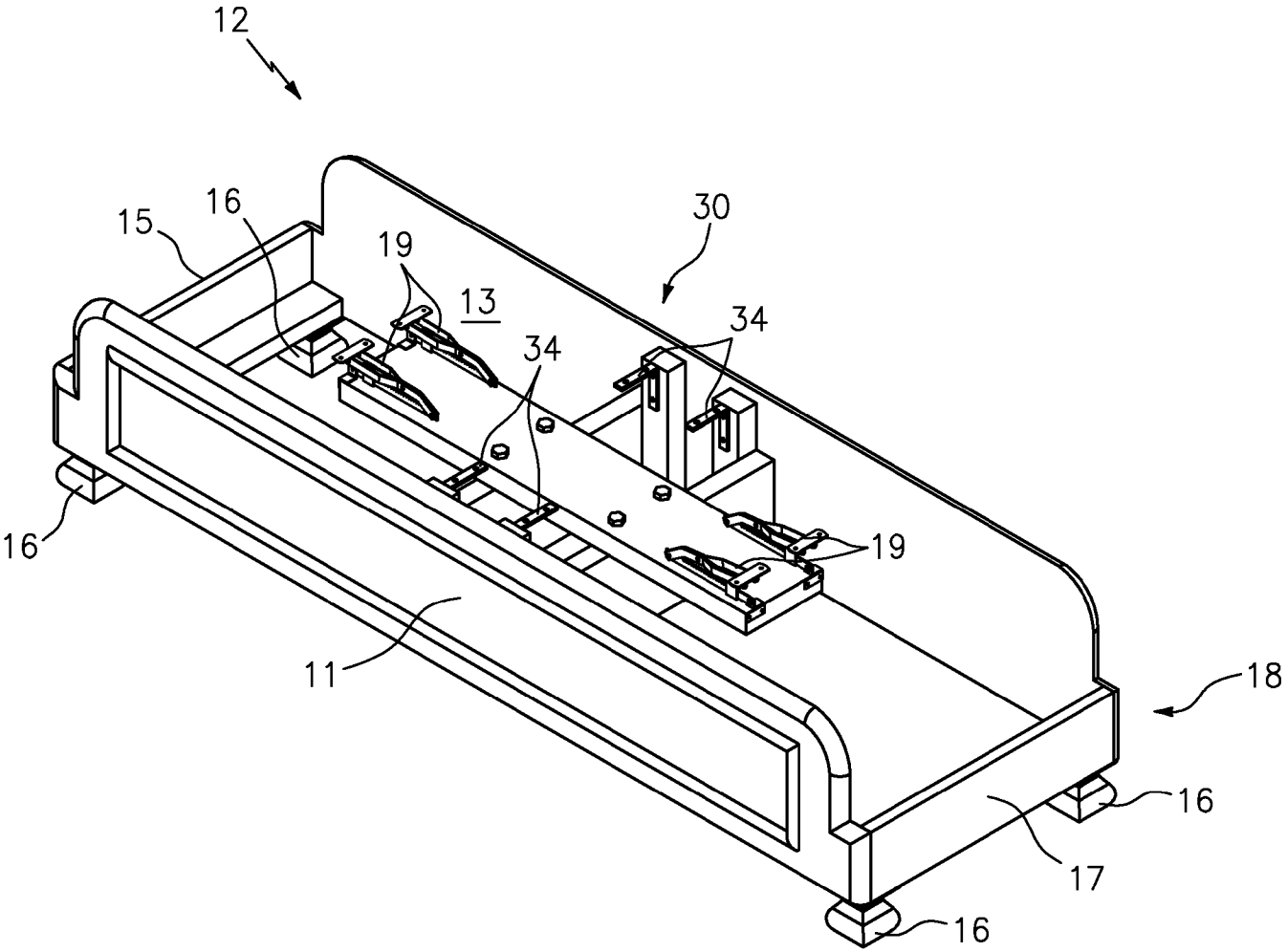
FIG. 2 shows a perspective view of the frame with the incline assembly removed to illustrate interior support structure of the frame, in accordance with the present disclosure.

FIG. 2 shows a perspective view of the frame 12 with the incline assembly 20 removed to illustrate interior support structure of the frame 12. The frame 12 further includes longitudinal support in the form of at least a pair of lower longitudinal support members, a front support member 11 and a back support member 13. The lower longitudinal support members 11 and 13 are preferably connected to first and second side support members 15 and 17, respectively. An assembly support structure 30 includes a support member 32 configured to couple to the incline assembly 20, described above. Brackets 34 may be included to further support the incline assembly 20. In one embodiment, the brackets 34 may be affixed to the front and back support members 11 and 13 and configured to receive the underside of the incline assembly 20. The support member 32 includes a plurality of lifting devices 19 for securing the incline assembly to the frame 12. The lifting devices 19 may be one or more mechanical ratcheting devices configured to selectively incline the incline assembly 20. Alternatively, the lifting devices 19 may be an electrical, pneumatic, or hydraulic device configured to selectively incline and hold the incline assembly 20 as preferred by an operator.

Figure 3:
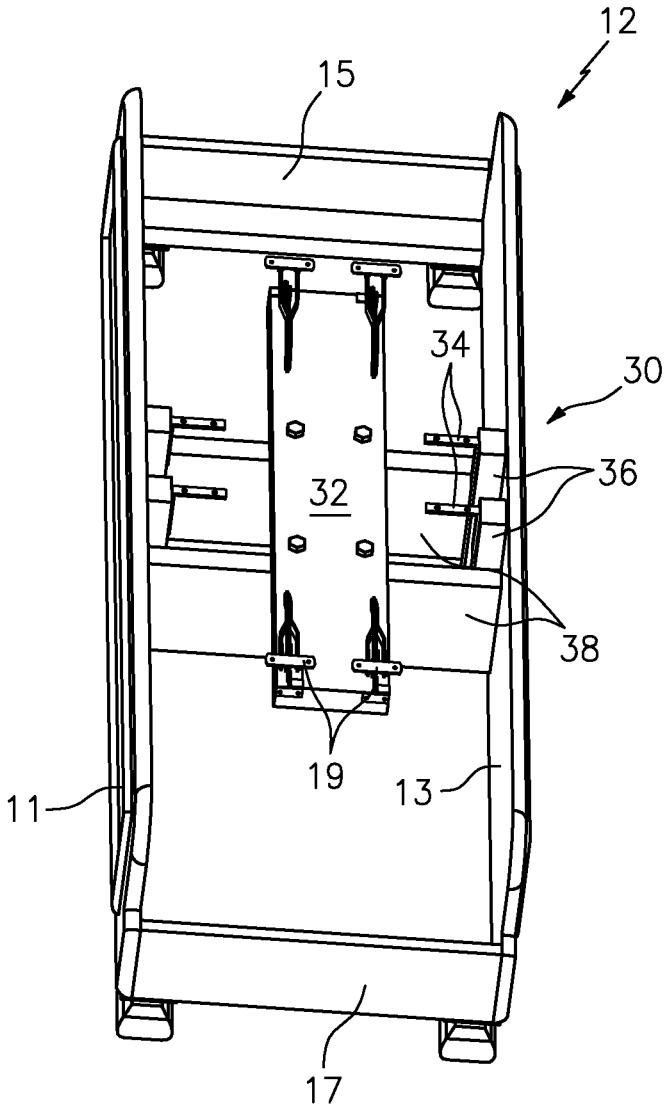
FIG. 3 shows a top view of the frame including the assembly support structure, in accordance with the present disclosure.

FIG. 3 shows a top view of the frame 12 including the assembly support structure 30. In one embodiment, the assembly support structure 30 includes a plurality of vertical members 36 attached to the front and back support members 11 and 13. The brackets 34 may be affixed to one or more of the vertical members 36. The vertical members 36 are preferably configured to receive one or more horizontal support members 38. The horizontal support members 38 are configured to support and attach to the support member 32.

Figure 4:
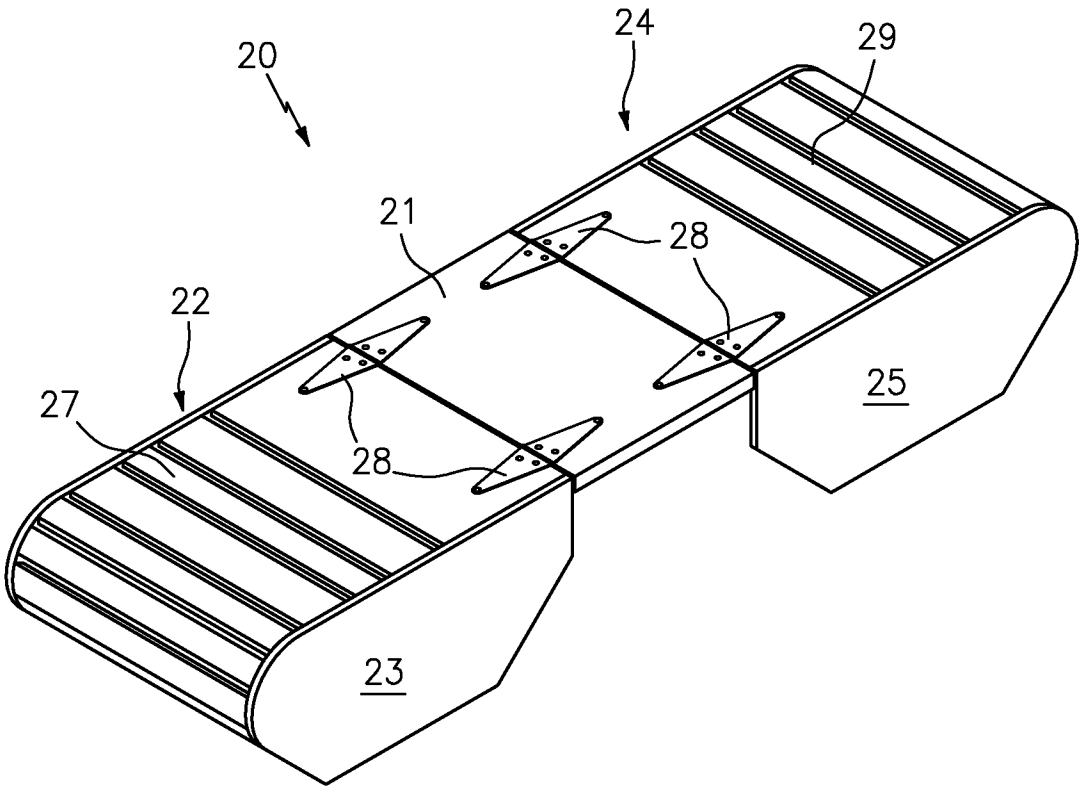
FIG. 4 shows a perspective view of the incline assembly unattached to the frame, in accordance with the present disclosure.

FIG. 4 shows a perspective view of the incline assembly 20 unattached to the frame 12. As described herein above, the incline assembly 20 includes a first incline section 22 and a second incline section 24. The sections 22 and 24 are configured to selectively pivot about the hinges 28. A middle support section 21 is preferably securely mechanically fastened to the frame 12. The first and second sections 22 and 24 include a pair of opposing side sections 23 and 25, respectively, having a plurality of surface elements 27 and 29 connected therebetween. As shown, the surface elements can extend along the first and second incline sections from a location that is adjacent to the middle section 21 along the topside, can transition the outermost edge (i.e., distal end) 45 of the first and second incline sections, and can continue along the underside of the first and second incline sections to a location that abuts the below described mechanical ratchet devices 19 (See FIGS. 5A, 5B and 8). In this regard, each of the surface elements 27 and 29 are configured to support a human user and, in one embodiment, receive an upholstery material. Side sections 23 and 25 extend downward from the topside, and are positionable inside the frame 12 when the assembly is not in an inclined position.

Figure 5A:
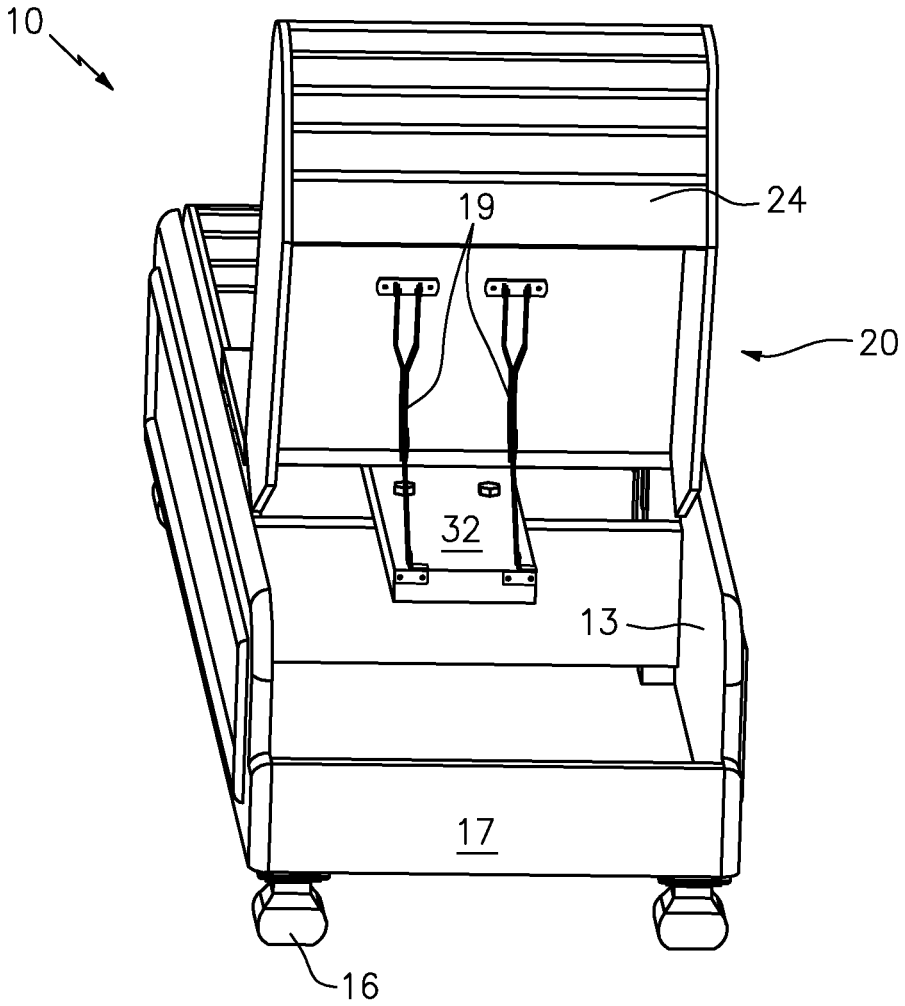
FIGS. 5A and 5B show the frame attached to the incline assembly, in accordance with the present disclosure.
Figure 5B:
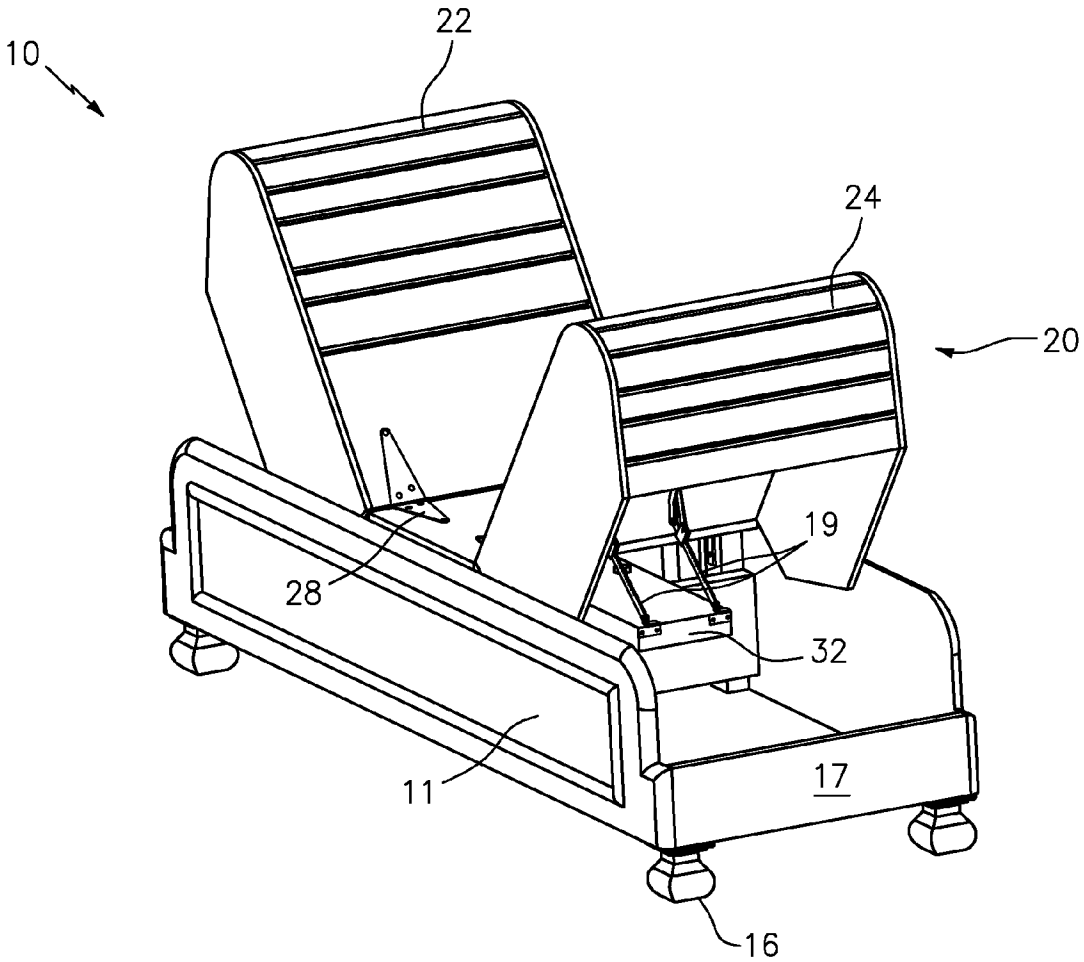

FIGS. 5A and 5B show the frame 12 attached to the incline assembly 20. FIG. 5A shows a first side of the incline assembly 20 inclined to illustrate the connection between the frame and the incline assembly 20. FIG. 5B shows the first and second sides of the incline assembly inclined. As FIGS. 5A and 5B show, the mechanical ratchet devices 19 connected to an underside of the first and second incline sections 22 and 24 function to allow a user to selectively incline the same to any desired angle.

Figure 6:
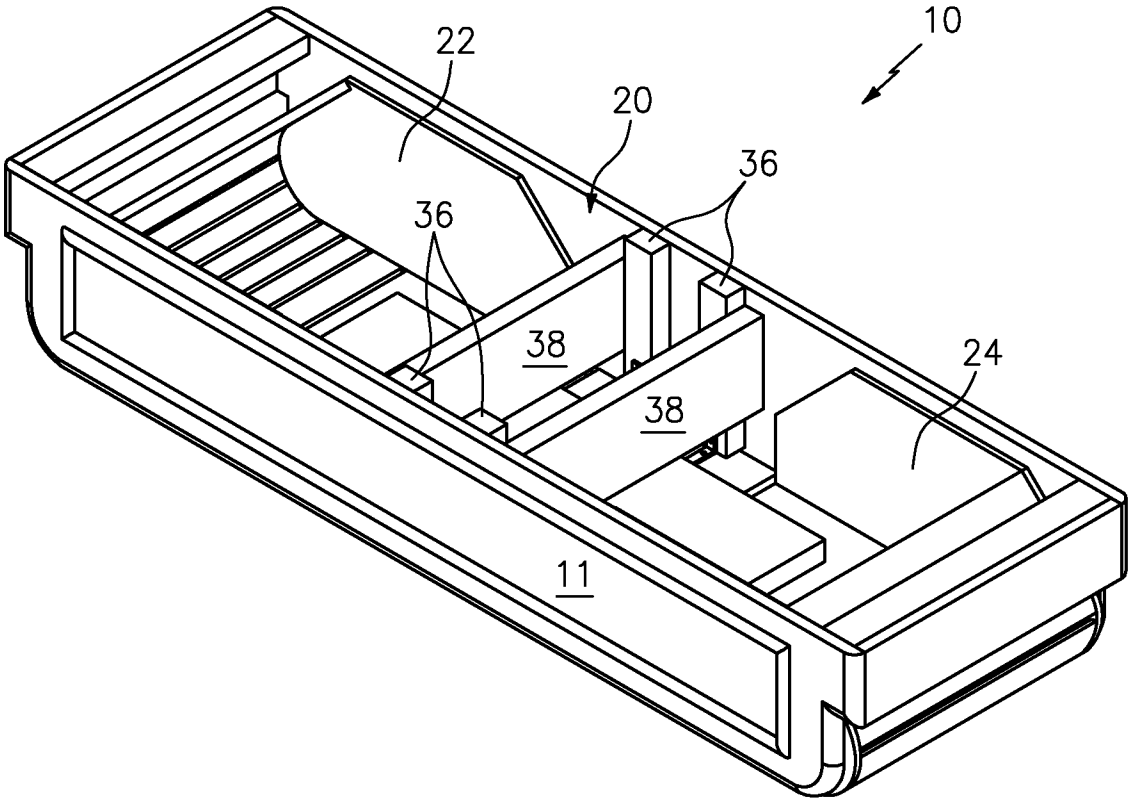
FIG. 6 shows a bottom view of the furniture apparatus having the frame attached to the incline assembly, in accordance with the present disclosure.

FIG. 6 shows a bottom view of the furniture apparatus 10 having the frame 12 attached to the incline assembly 20. As FIG. 6 shows, the vertical members 36 may be adapted to attach to the frame 12 along the vertical length of the front and back support members 11 and 13. The incline assembly 20 is preferably substantially contained within the frame 12 when in a non-inclined position.

Figure 7B:
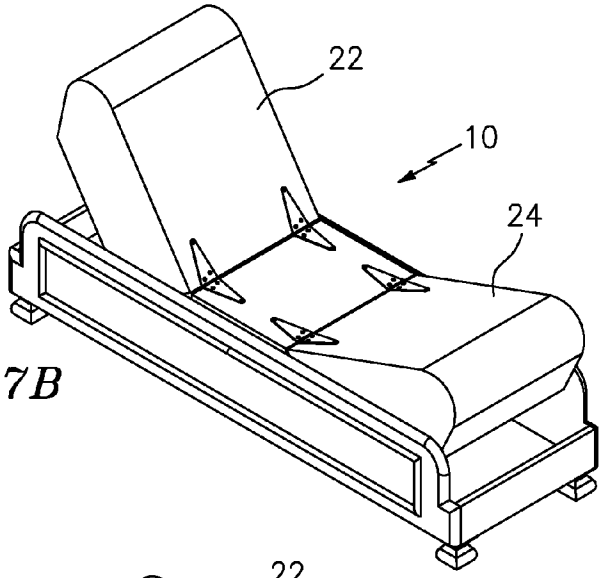
FIGS. 7A-7D show various exemplary positions of the inclinable sections of the furniture apparatus, in accordance with the present disclosure.
Figure 7D:
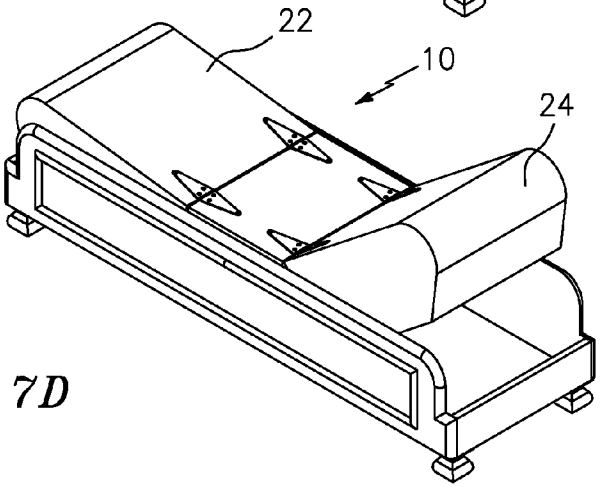
Figure 7A:
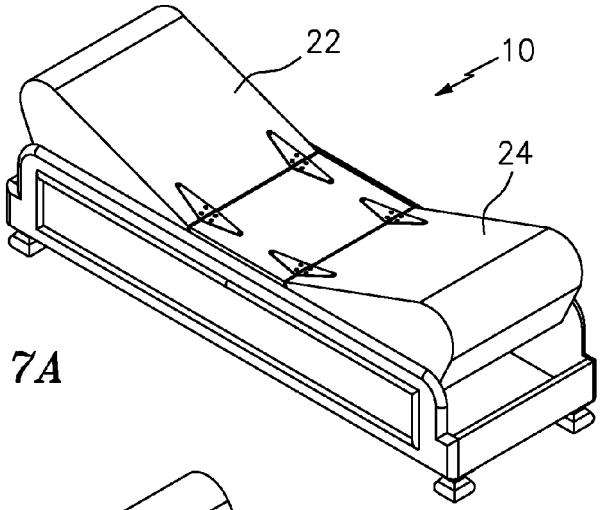
Figure 7C:
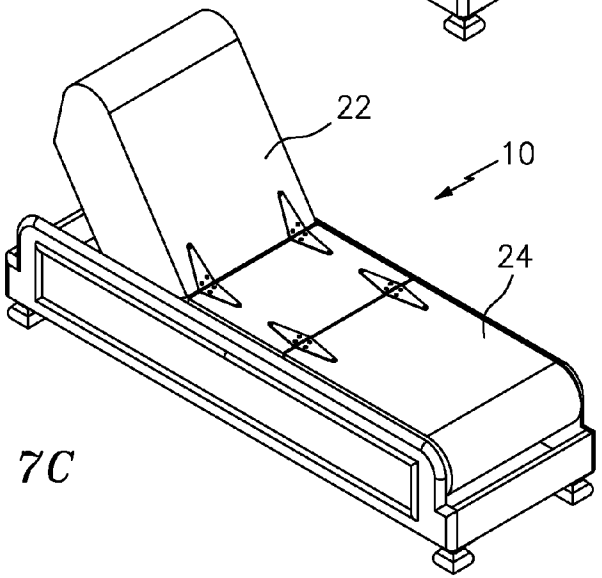

FIGS. 7A-7D show various exemplary positions of the inclinable sections 22 and 24 of the furniture apparatus 10. FIG. 7A shows the first and second inclinable section 22 and 24 at a slight incline. FIG. 7B shows the first inclinable section 22 at a steeper incline with the second section 24 slightly inclined. FIG. 7C shows the first inclinable section 22 at a steeper incline with the second inclinable section 24 at a non-inclined section. FIG. 7D shows the first inclinable section 22 at a slight incline and the second inclinable section 24 at a steeper incline. It is contemplated by the disclosure that the inclinable sections 22 and 24 may be selectively inclined to a plurality of respective positions. In one embodiment, each inclinable section 22 and 24 can be configured to selectively incline to nineteen distinct incline angles. The number and degree of incline may be adapted for a particular sized furniture apparatus and for particular adaptations of the mechanical ratchet devices 19.

Figure 8A:
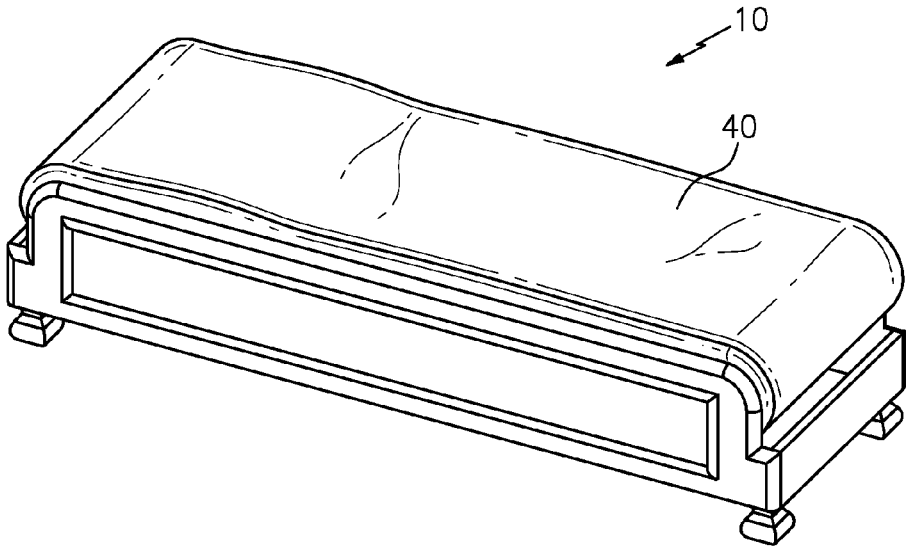
FIGS. 8A and 8B show the furniture apparatus including the incline assembly having an upholstered exterior, in accordance with the present disclosure.
Figure 8B:
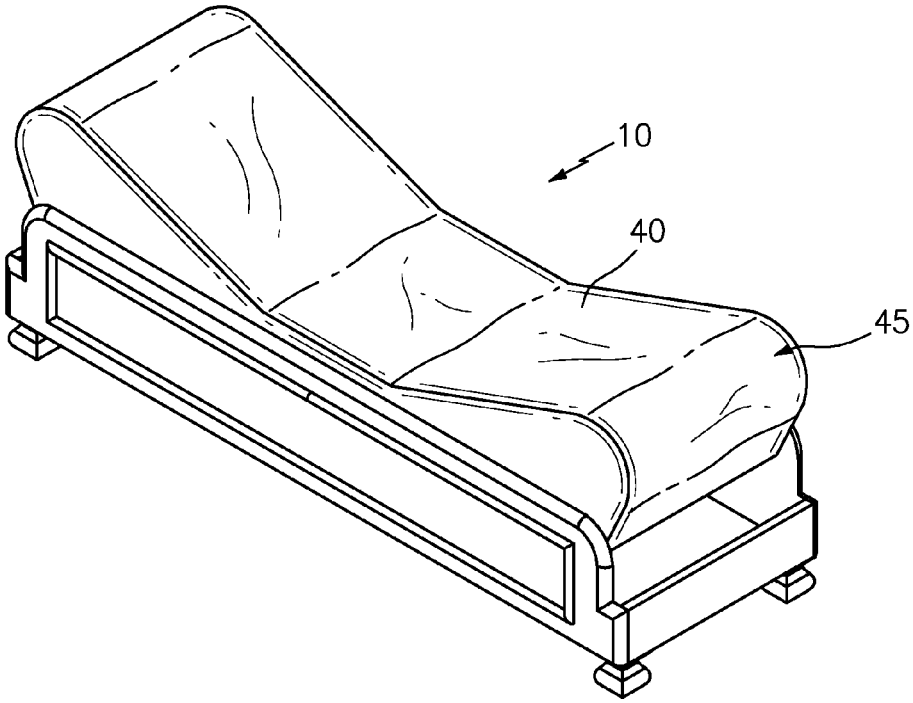

FIGS. 8A and 8B show the furniture apparatus 10 including the incline assembly 20 having a padded and upholstered exterior. FIG. 8A shows the furniture apparatus 10 in an exemplary non-inclined position, while FIG. 8B shows the furniture apparatus 10 in an exemplary dual-inclined position. The furniture apparatus 10 preferably includes a covering of upholstery material for durability and to add to the overall attractiveness of the apparatus such as e.g., pleather upholstery material. The covering may be formed integrally with padding or may be a separate wrapper that encompasses the padding attached with a zipper closure. For example, the upholstered top 40 may include a layer of open cell foam covered by upholstery material in the usual manner well known in the art. The foam material may be flat or have some type of shape that would add to the aesthetics of the apparatus. The upholstery 40 preferably covers the external surface of the incline assembly 20 to hide underside surfaces of the assembly 20 and the various support members and lifting devices. The disclosure herein can be applied to various upholstery designs and arrangements and is therefore not intended to be limited thereby.

As described herein, the furniture apparatus 10 provides a sturdy structural frame and incline assembly capable of supporting the weight of two or more active adults along any portion of the assembly. As such, should two adults choose to sit on the outermost edge of one side of the assembly 45, for example, the frame and remaining portions of the device will remain securely in place and will not move. Such a feature allows the apparatus 10, which can also include any number of decorative elements inlayed or otherwise secured thereon to function as described above, while discretely concealing its true purpose.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. An inclinable furniture apparatus, comprising:

a frame having a front member, a back member, a first side member, and a second side member, said front and back members including a length and height that is greater than a length and height of the first and second side members;

an incline assembly that includes a first inclinable section, a second inclinable section, and a center support section, wherein the first inclinable section, the second inclinable section, and the center support section each comprise a top surface configured to support one or more human users, and each of the first and second inclinable sections further include a distal end that is also configured to support one or more human users, wherein the top surface of each of the first inclinable section, the second inclinable section and the center support section are positioned generally flush with a top surface of the front and back frame members, and the distal ends of the first and second inclinable sections are positioned completely above a top surface of the first and second side members, when the apparatus is not in an inclined position;

a plurality of lifting devices configured to selectively incline and support the first and second inclinable sections, wherein at least one of the plurality of the lifting devices are attached to the frame and an underside of the first inclinable section and at least one of the plurality of the lifting devices are attached to the frame and an underside of the second inclinable section; and a cover disposed over portions of the incline assembly, wherein each of the frame, the incline assembly and the plurality of lifting devices function to support a weight of two or more adults that are seated along the distal end of one of the first and second inclinable section.

2. The furniture apparatus of claim 1, further comprising an internal support structure comprising:

a plurality of vertical members attached to the front member and a second plurality of vertical members attached to the back member of the frame; and a plurality of horizontal members attached to one or more of the plurality of vertical members and configured to join the front member and the back member.

3. The furniture apparatus of claim 2, wherein the internal support structure further comprises: a support member attached to each of the plurality of horizontal members.

4. The furniture apparatus of claim 1, wherein the lifting devices comprises a mechanical ratcheting device.

5. The furniture apparatus of claim 1, wherein the lifting devices comprises an electro-mechanical lifting device.

6. The furniture apparatus of claim 1, wherein the lifting devices comprises a hydraulic lifting device.

7. The furniture apparatus of claim 1, wherein the lifting devices comprises a pneumatic lifting device.

8. The furniture apparatus of claim 1, further comprising padding material disposed between the cover and the incline assembly.

9. The furniture apparatus of claim 1, wherein the first inclinable section is connected to the center support section using one or more hinge devices and the second inclinable section is connected to the center support section using one or more hinge devices.

10. The furniture apparatus of claim 2, wherein the frame encloses an exterior perimeter of the incline assembly and is adapted to conceal the internal support structure when the inclinable furniture apparatus is at a non-inclined position.

11. The furniture apparatus of claim 1, wherein the cover is disposed over an entirety of the top surface, a side surface, and the distal ends of each of the first and second inclinable sections.

12. The furniture apparatus of claim 11, further comprising:

padding material that is disposed between the cover and the incline assembly.

13. An inclinable furniture apparatus that consists of:

a frame having a front member, a back member, a first side member, and a second side member, said front and back members including a length and height that is greater than a length and height of the first and second side members;

an incline assembly that includes a first inclinable section, a second inclinable section, and a center support section, wherein the first inclinable section, the second inclinable section, and the center support section each comprise a top surface configured to support one or more human users, and each of the first and second inclinable sections further include a distal end that is also configured to support one or more human users, wherein the top surface of each of the first inclinable section, the second inclinable section and the center support section are positioned generally flush with a top surface of the front and back frame members, and the distal ends of the first and second inclinable sections are positioned completely above a top surface of the first and second side members, when the apparatus is not in an inclined position;

a plurality of lifting devices configured to selectively incline and support the first and second inclinable sections, wherein at least one of the plurality of the lifting devices are attached to the frame and an underside of the first inclinable section and at least one of the plurality of the lifting devices are attached to the frame and an underside of the second inclinable section; and a cover disposed over portions of the incline assembly.

14. The furniture apparatus of claim 13, wherein the cover is disposed over an entirety of the top surface, a side surface, and the distal ends of each of the first and second inclinable sections.

15. The furniture apparatus of claim 14, further comprising:

padding material that is disposed between the cover and the incline assembly.

16. The furniture apparatus of claim 13, wherein each of the frame, the incline assembly and the plurality of lifting devices function to support a weight of two or more adults that are seated along the distal end of one of the first and second inclinable section.

* * * * *